US006101648A

United States Patent [19]

Sommerfeld et al.

[11] Patent Number: 6,101,648

[45] Date of Patent: Aug. 15, 2000

[54] RAMP ASSEMBLY FOR AN ARTICULATING BED

[75] Inventors: Dean R. Sommerfeld, Iola; John L. Edgerton, Jr., Stevens Point, both of Wis.

[73] Assignee: Sunrise Medical CCG Inc., Stevens Point, Wis.

[21] Appl. No.: 09/064,246

[22] Filed: Apr. 22, 1998

[51] Int. Cl.[7] ..... A61G 7/005; A61G 7/015

[52] U.S. Cl. ..... 5/618; 5/613

[58] Field of Search ..... 5/618, 613–617, 5/424

[56] References Cited

U.S. PATENT DOCUMENTS

| | | | |
|---|---|---|---|
| 1,573,530 | 2/1926 | Weaver | 5/618 |
| 2,026,153 | 12/1935 | Wright et al. | 5/618 |
| 2,631,300 | 3/1953 | Murray | 5/616 |
| 3,447,170 | 6/1969 | Spitz | 5/618 |
| 3,898,702 | 8/1975 | Goodman | 5/618 |
| 4,715,073 | 12/1987 | Butler | 5/610 |

*Primary Examiner*—Alexander Grosz

*Attorney, Agent, or Firm*—MacMillan, Sobanski & Todd, LLC

[57] ABSTRACT

A ramp assembly for an articulating bed for preventing interference of a movable bed component with a stationary bed component comprises a ramp and a contact member. The ramp is attached to either the movable bed component or the stationary bed component. The contact member is connected to the other bed component in a manner such that it contacts the ramp. The contact member and the ramp cooperate to maintain a spaced relation between the movable bed component and the stationary bed component during movement of the movable component.

3 Claims, 6 Drawing Sheets

RAMP ASSEMBLY FOR AN ARTICULATING BED

BACKGROUND OF THE INVENTION

The present invention relates to ramp assembly for an articulating bed and more particularly, to a ramp assembly for preventing interference of a movable section of an articulating bed with a stationary section of the bed.

Articulating beds are beds that include movable components. The moving components typically include a head section, a knee section, and a foot section that combine to provide a sleep surface. A bed frame pivotally supports the head and knee sections, and the foot section is pivotally attached to knee section. The head section generally moves to elevate the user's head and the knee and foot sections move to elevate the user's knees. A linear actuator, such as a screw assembly, can effect movement of the head section and the knee section. A separate screw assembly is required to effect movement of each section. Each screw assembly is typically actuated electrically by a prime mover, such as a motor and a cooperating gear train. Alternatively, the screw assemblies can be actuated manually by a hand crank. With regard to an electrically actuated screw assembly, the motor is usually fixed relative to the frame of the bed, such as through the use of a motor mounting channel. The gear train translates rotational movement from the motor to a screw. The screw threadably engages a drive tube. The drive tube effects movement of the head and knee sections when the motor is operated. The foot section moves in response to movement of the knee section. As the foot section moves, the foot section typically experiences interference with stationary components of the bed, such as the bed frame or the motor mounting channel. This interference causes noise, wear on moving and stationary bed components, and hinders a smooth operation of the bed. Attempts to overcome this interference have included the use of elaborate linkage assemblies and a need for cumbersome riveting.

An apparatus is desired that substantially reduces or prevents interference between movable and stationary bed components without the aid of elaborate linkage assemblies and the need for cumbersome riveting. Such an apparatus would provide a smoother operation of the movable bed components, reduce wear on movable as well as stationary components, and eliminate noise produced by the interference.

SUMMARY OF THE INVENTION

The present invention is a ramp assembly for an articulating bed. More particularly, the present invention is a ramp assembly for preventing interference of a movable bed component with a stationary bed component. The ramp assembly comprises a ramp and a contact member. The ramp is attached to either the movable bed component or the stationary bed component. The contact member is connected to the other bed component in a manner such that it contacts the ramp. The contact member and the ramp cooperate to maintain a spaced relation between the movable bed component and the stationary bed component during movement of the movable component.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
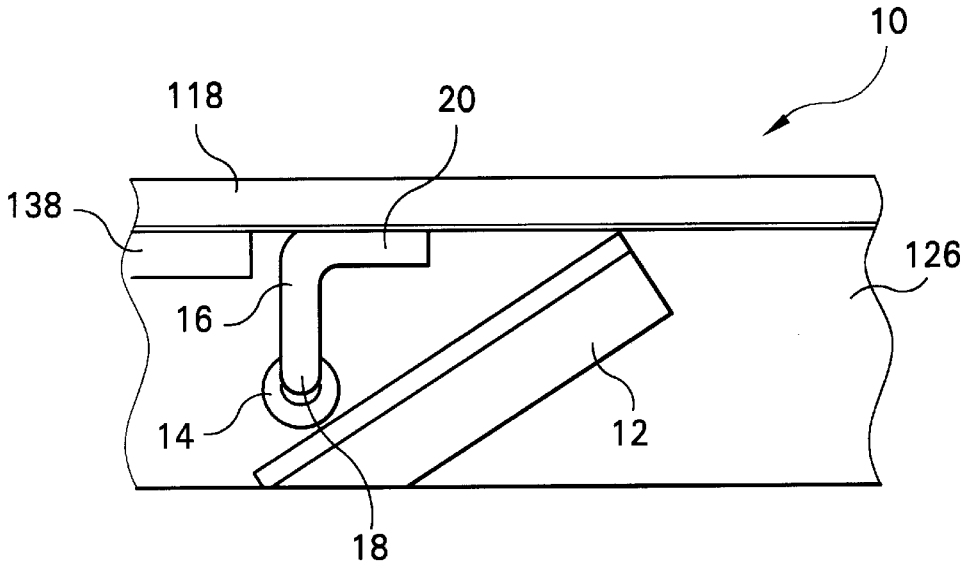
FIG. 1 is an enlarged environmental side elevation of a ramp assembly according to the present invention attached to a movable component and a stationary component of an articulating bed.
Figure 10:
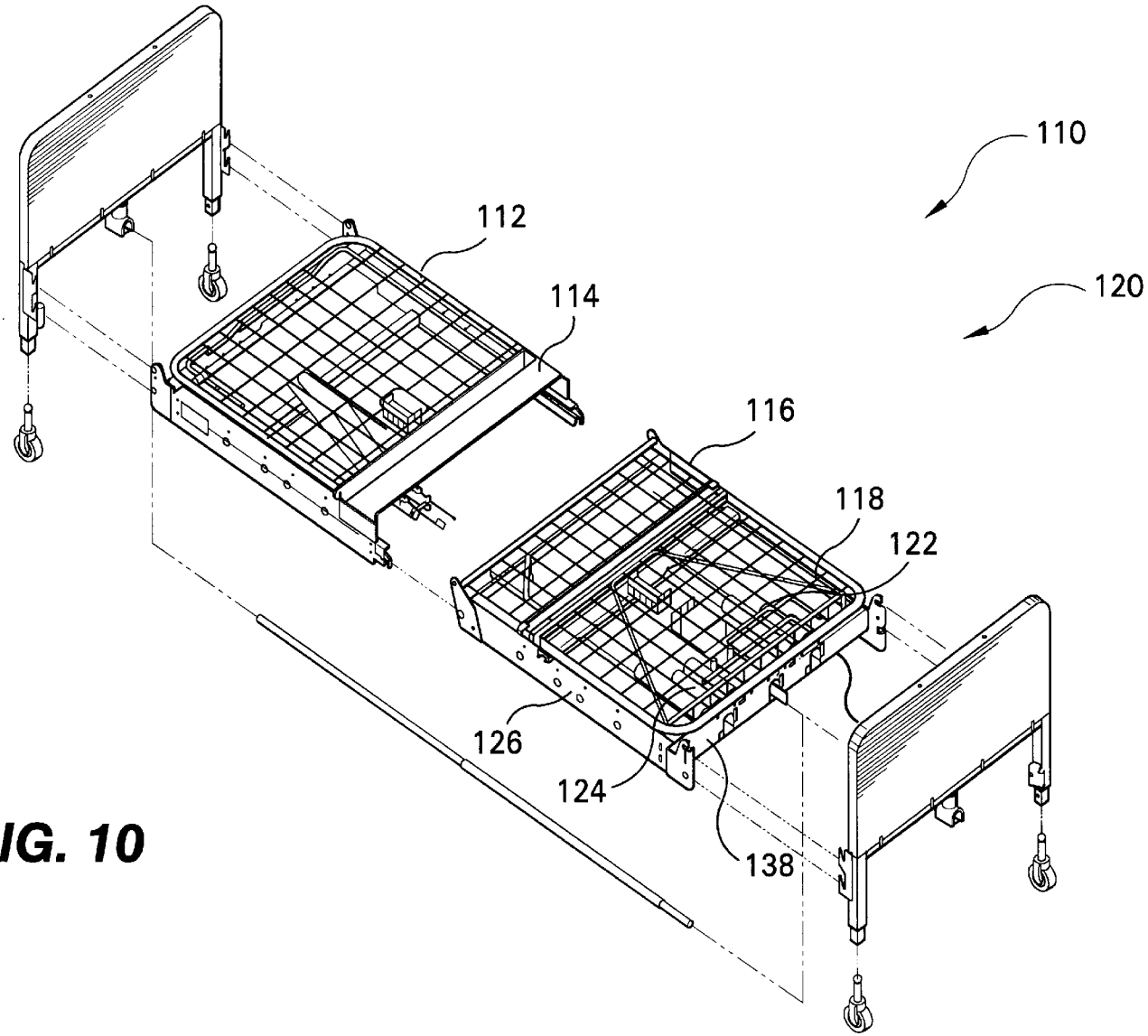
FIG. 10 is an exploded perspective view of an articulating bed.

Referring now to the drawings, there is illustrated in FIG. 1 an embodiment of a ramp assembly 10 for use with an articulating bed. An articulating bed 110 is one that has one or more movable components. For example, the articulating bed 110 shown in FIG. 10 has four bed sections including a head section 112, a seat section 114, a knee section 116, and a foot section 118. The head section 112, seat section 114, knee section 116, and foot section 118 define a sleep surface 120. The head section 112, the knee section 116, and the foot section 118 include a mattress support grid for supporting a mattress (not shown). The seat section 114 includes a generally rectangular plate. The head section 112, the knee section 116, and the foot section 118 are all movable components. The seat section 114 is typically fixed. Linear actuators, such as the screw assemblies 122, 124 shown, can effect movement of the movable bed components 112, 116. A bed frame 126 supports the four bed sections 112, 114, 116, 118 and the two screw assemblies 122, 124. The head section 112 and the knee section 116 are pivotally attached to the bed frame 126. The foot section 118 has a first end which is pivotally attached to the knee section 116 and a second, free end supported by the bed frame 126 indirectly by the ramp assembly 10. The seat section 114 and the screw assemblies 122, 124 are fixedly attached to the bed frame 126.

Figure 3:
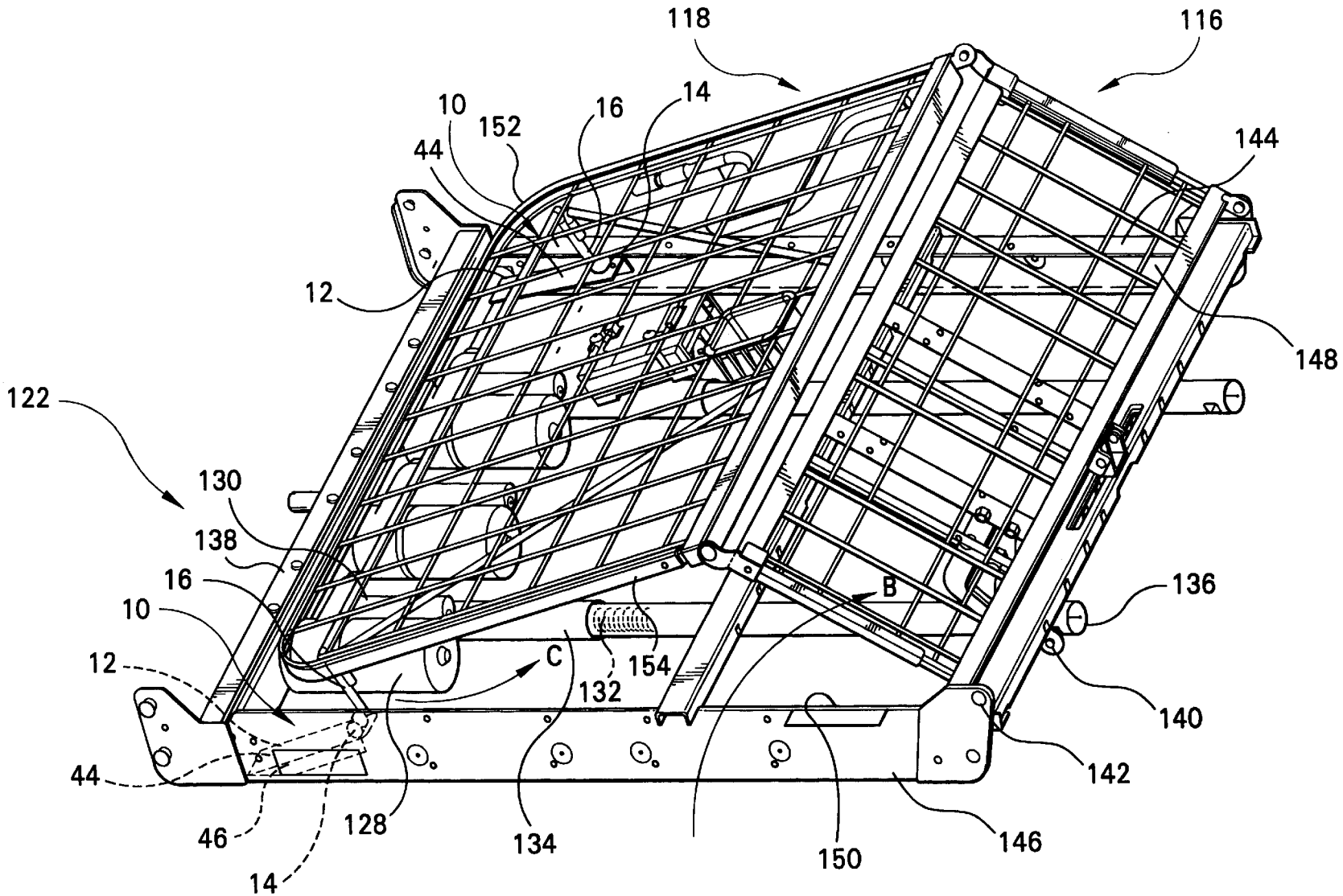
FIG. 3 is an environmental top perspective view of a ramp assembly comprising two ramps, two contact members, and two legs.

As shown in FIG. 3, a screw assembly 122 includes a motor 128, a gear train 130, a screw 132, a dust sleeve 134 covering the screw 132, and a drive tube 136 threadably engageable with the screw 132. The motor 128 is attached to the bed frame 126 through a motor mounting channel 138. When the motor 128 is actuated, the screw 132 effects linear displacement of drive tube 136. The drive tube 136 is coupled to the knee section 116. Displacement of the drive tube 136 effects movement of the head section 112 and the knee section 116. Movement of the knee section 116, in turn, effects movement of the foot section 118. The ramp assembly 10 ensures that the foot section 118, a movable bed component, remains spaced from the stationary bed components and most particularly, spaced from the motor mounting channel 138 during movement of the foot section 118. Thus, the ramp assembly 10 prevents the foot section 118 from contacting stationary bed components during movement of the foot section 118.

Referring back to FIG. 1, a ramp assembly 10 is shown including a ramp 12 and a contact member defined by a wheel 14. The ramp 12 is attached to the bed so as to remain in a fixed position relative to the bed frame 126 of the bed. This can be accomplished by attaching the ramp 12 to the bed frame 126 or a stationary component of the bed. The wheel 14 is held in contact with the ramp 12 and spaced apart from the foot section 118. This can be accomplished by connecting the wheel 14 to the foot section 118 of the bed with a leg 16 having a predetermined length. Gravitational force acting upon the leg 16 and foot section 118 will hold the wheel 14 in contact with the ramp 12 and the leg 16 will hold the wheel 14 spaced apart from the foot section 118 a distance equivalent to the length of the leg 16. The leg 16 shown comprises two ends, namely, a first end 18 and a second end 20. The wheel 14 is attached to the first end 18 of the leg 16 in a manner such that the leg 16 rotatably supports the wheel 14. The second end 20 of the leg 16 is attached to a free end of the foot section 118 of the bed. The second end 20 of the leg 16 is preferably attached to a free end of the foot section 118 so as to extend perpendicularly from the foot section 118. Moreover, the second end of the leg 16 is preferably fixedly or rigidly attached to the foot section 118 so as to maintain the perpendicular relationship between the leg 16 and the foot section 118. The fixed perpendicular relationship maintains a substantially constant space relation between the contact member 14 and the foot section 118 during movement of the foot section 118. This ensures that the foot section 118 remains spaced apart from stationary bed components, such as the motor mounting channel 138, during movement of the foot section 118, thus preventing the foot section 118 from contacting the stationary components.

Referring back to FIG. 3, the operation of the ramp assembly 10 relative to the movement of the foot section 118 is characterized as follows. As briefly described above, the motor 128 turns the gear train 130, which, in turn, turns a screw 132. Alternatively, a hand crank (not shown) can turn the screw 132. The screw 132 displaces a drive tube 136. The drive tube 136 effects movement of a knee lever arm 140. The knee lever arm 140 cantilevers causing the knee section 116 to pivot upward in the direction B on a fulcrum 142. As the knee section 116 pivots upward, the foot section 118 trails the knee section 116 in the general direction C. As the foot section 118 trails the knee section 116, the wheel 14 progresses up the ramp 12 in the direction D, as is clearly illustrated in FIG. 2. The leg 16 remains fixed relative to the foot section 118. Hence, as the wheel 14 increases in elevation, the foot section 118 increases in elevation so as to remain spaced apart from stationary bed components, such as the motor mounting channel 138 shown.

Continuing with reference to FIG. 3, the ramp 10 assembly can include two ramps 12, two contact members 14, and two legs 16. The bed frame of the articulating bed shown includes opposite sides, generally indicated as 144, 146. Each side 144, 146 has an inner side surface 148, 150. Each ramp 12 attaches to a respective one of the inner surfaces 148, 150 at an angle of inclination. The angle of inclination of each ramp 12 is dependent upon several factors including: (1) the length of the knee and foot sections 116, 118; (2) the rate and amount of displacement of the knee sections 116; (3) the placement of the contact member 14 relative to the foot section 118; and (4) length of the leg 16. It should be understood that this list of factors is not an exhaustive list of factors affecting the angle of inclination of the ramp 12. Each ramp 12 includes a substantially planar ramp surface 44 and a mounting surface 46. The mounting surface 46 shown is perpendicular to the ramp surface 44. The ramp surface 44 can be integral with the mounting surface 46, as is shown. The dimensions of the ramp surface 44 are dependent upon factors such as: (1) the length of the knee and foot sections 116, 118; (2) the rate of displacement of the knee section 116; (3) the amount of displacement of the foot section 118; and (3) structural limitations imposed by the bed frame 126 and other components parts. It should be understood that this is not an exhaustive list of factors affecting the dimensions of the ramp 12. Each contact member 14 contacts a ramp surface 44 of a corresponding one of the ramps 12. Each leg 16 connects a corresponding contact member 14 to a respective one of the opposed sides 152, 154 of the foot section 118. Each leg 16 is fixedly attached to an opposed side 152, 154 of the foot section 118 so as to remain perpendicular with the foot section 118. The contact member 14 is held in contact with the ramp 12 and spaced apart from the foot section 118. Gravitational force acts upon each leg 16 and the foot section 118 to hold each contact member 14 in contact with a corresponding ramp 12. The legs 16 hold the contact members 14 spaced apart from the foot section 118 a distance substantially equivalent to the length of the leg 16. Each contact member 14 may be in the form of a wheel rotatably attached to a corresponding one of the legs 16. Although two ramps 12, two contact members 14, and two legs 16 are provided, it should be understood that a ramp assembly 10 comprising a single ramp 12, a single contact member 14, and a single leg 16 may be sufficient for carrying out the present invention. Regardless of whether one or a plurality of ramps 12, contact members 14, and legs 16 are employed, the movement of the foot section 118 and the ramp assemblies 10 remains as characterized above with reference to FIGS. 2 and 3.

Figure 4:
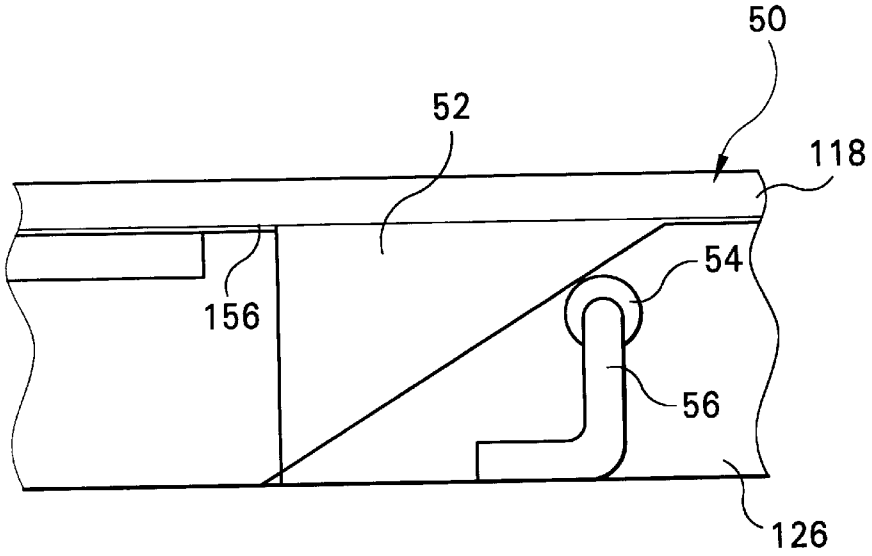
FIG. 4 is an enlarged environmental side elevation of another ramp assembly.
Figure 5:
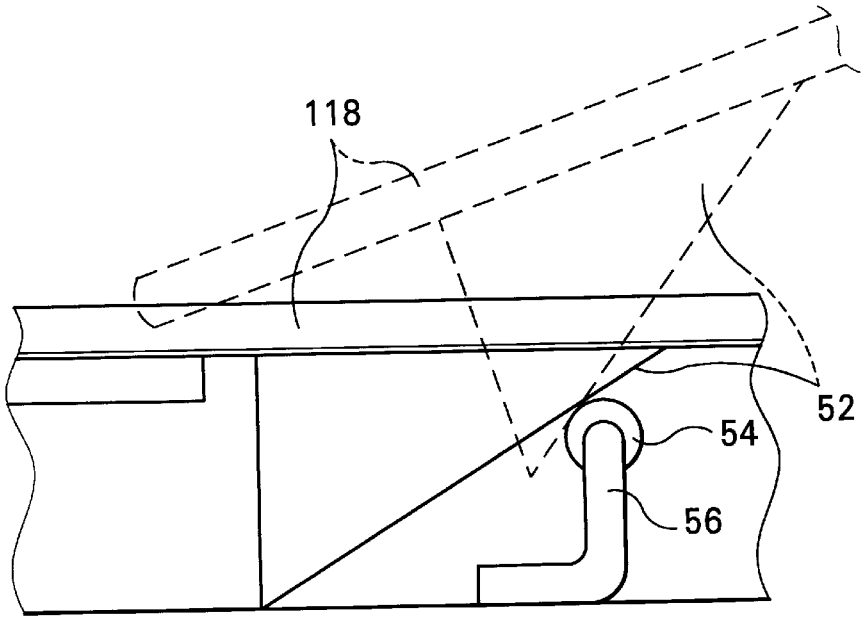
FIG. 5 is an enlarged environmental side elevation of the ramp assembly shown in FIG. 4 further showing movement of the contact member of the ramp assembly in phantom lines.

In another embodiment, a ramp assembly 50 can be inverted and reversed in orientation. The ramp 12 can be mounted to an undersurface 156 of the foot section 118, as illustrated in FIGS. 4 and 5. In this embodiment, the contact member 54 is still held in contact with the ramp 52. However, the leg 56 is inverted and fixedly attached to the bed frame 126, or some other bed component that remains stationary relative to the foot section 118. As the knee section 116 pivots upward and the foot section 118 trails behind the knee section 116 (as described above with reference to FIGS. 2 and 3), the contact member 54 progresses along the ramp 52 attached to the undersurface 156 of the foot section 118, as is clearly shown in FIG. 5. As the contact member 54 progresses along the ramp 52, the foot section 118 increases in elevation so as to remain spaced apart from stationary bed components. It should be understood that this embodiment can be carried out with a single ramp 52, a single contact member 54, and a single leg 56, or a plurality of ramps 52 and contact members 54 and legs 56.

Figure 2:
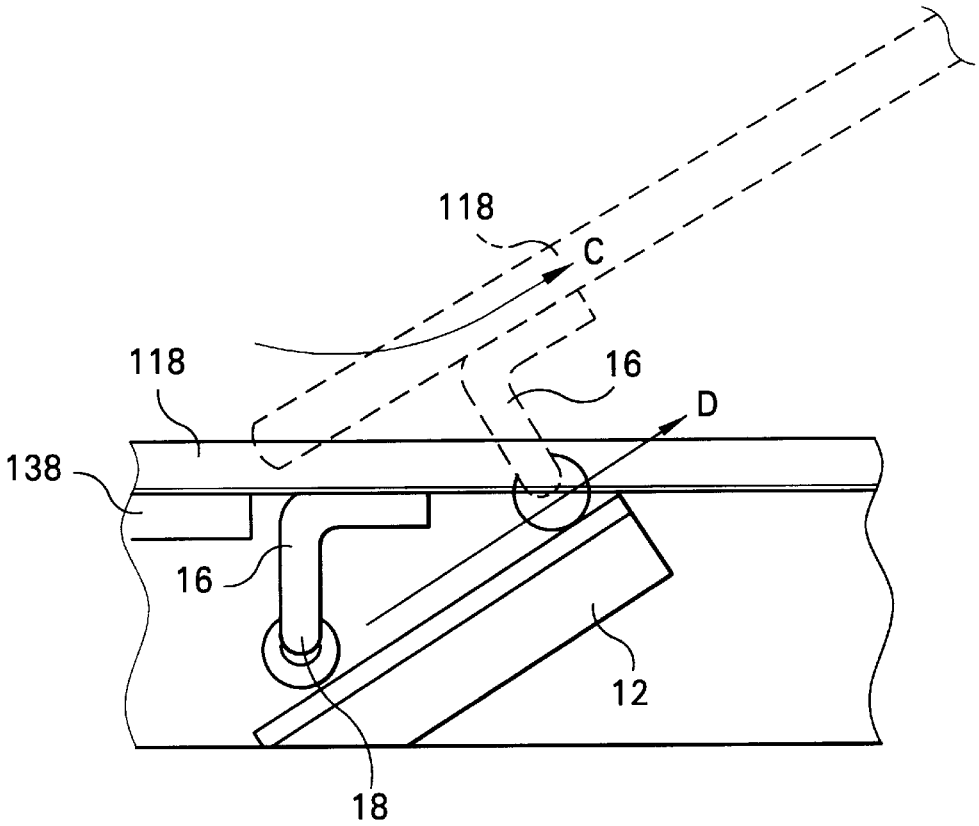
FIG. 2 is an enlarged environmental side elevation of the ramp assembly shown in FIG. 1 further showing movement of the contact member of the ramp assembly in phantom lines.
Figure 6:
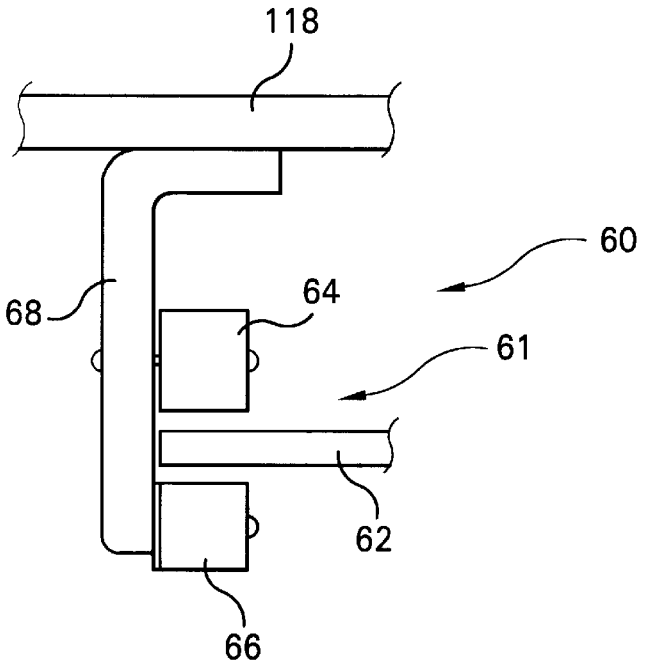
FIG. 6 is an enlarged partial front elevation of another ramp assembly comprising a contact member comprising two wheels.
Figure 7:
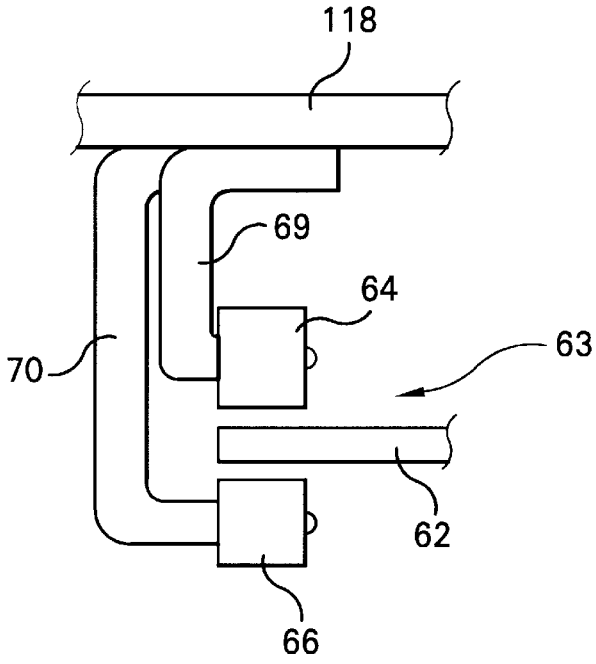
FIG. 7 is an enlarged partial front elevation of another ramp assembly comprising a contact member comprising two wheels and two legs.

In another embodiment of the ramp assembly 60, shown in FIG. 6, a contact member 61 comprising two wheels 64, 66 is provided. The wheels 64, 66 are each disposed on an opposing surface of a ramp 62. The wheels 64, 66 can be rotatably supported by a single leg 68. Alternatively, the wheels 64, 66 can be supported by two legs 69, 70, as shown in FIG. 7. In these two embodiments, the wheels 64, 66 trap the ramp 62 and substantially remain in contact with the ramp 62. Hence, as the foot section 118 is elevated, the wheels 64, 66 will not rise off the ramp 62. These configurations are equally useful on ramp assemblies such as shown in FIGS. 1 through 3, or on ramp assemblies as shown in FIGS. 4 and 5.

Figure 8:
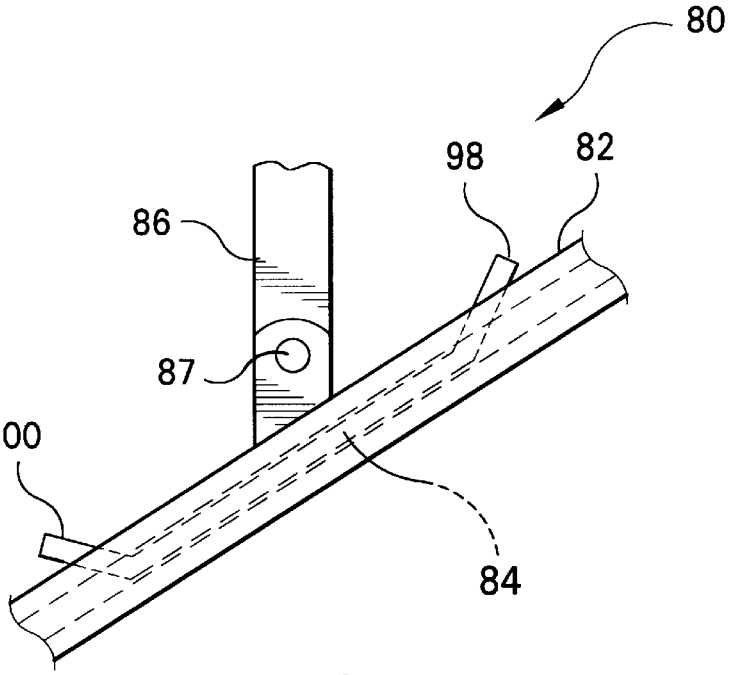
FIG. 8 is an enlarged partial side elevation of yet another ramp assembly comprising a contact member comprising a sled.
Figure 9:
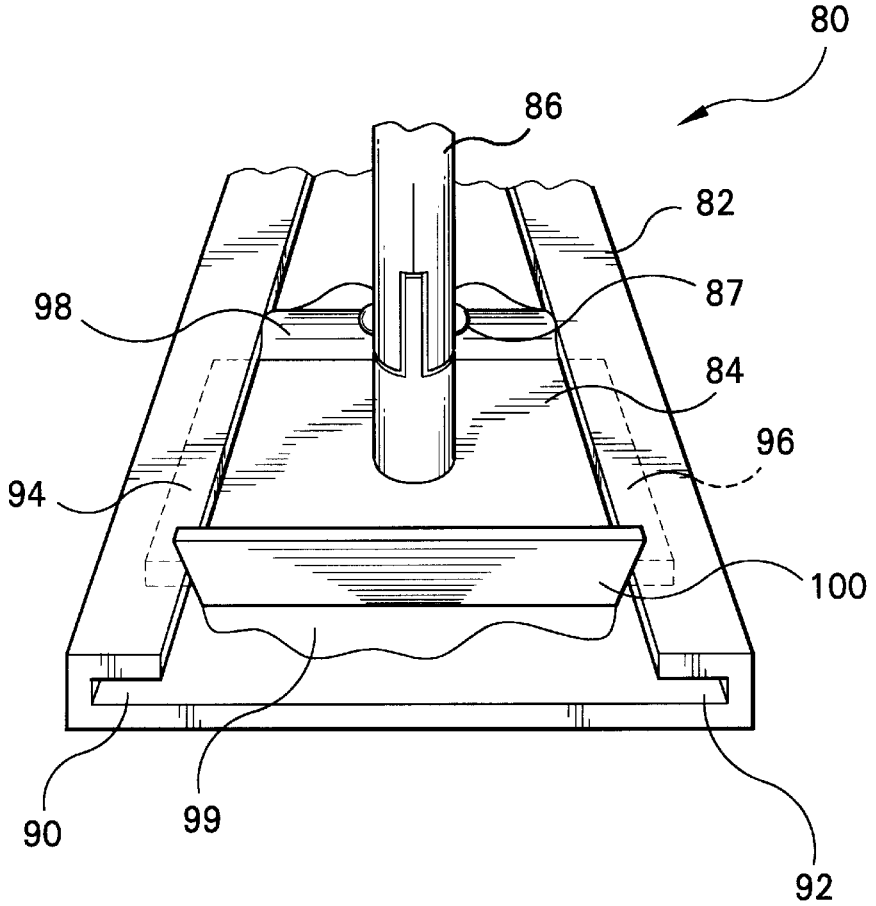
FIG. 9 is an enlarged partial front perspective view of the ramp assembly shown in FIG. 8.

Another embodiment of the ramp assembly 80 is shown in FIGS. 8 and 9. This embodiment includes a contact member 82 in the form of a slidable member, such as the sled 84 shown. The sled 84 is preferably pivotally attached to the leg 86 by pivot 87. The pivotal attachment reduces the risk of the sled 84 galling or binding as the sled 84 progresses along the ramp 82. In this embodiment, the ramp 82 may be provided with opposed channels 90, 92 for receiving opposed side edges 94, 96 of the sled 84. The sled 84 can be provided with an upturned lip 98, 100 fore and aft of the sled 84 to further reduce the risk of the sled 84 galling or binding as the sled 84 progresses along the ramp 82. To further reduce the risk of the sled 84 galling and binding, or to otherwise ensure smooth operation of the ramp assembly 80, a friction reduction substance 99, such as graphite, may be employed on the ramp 12. It should be understood that this configuration is equally useful on a ramp assembly comprising one or more contact members, as shown in FIGS. 1 through 3, and on ramp assemblies that are inverted, as shown in FIGS. 4 and 5.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An articulating bed comprising:

a bed frame;

a knee section pivotally attached to said bed frame so that said knee section is adapted to move relative to said bed frame;

a foot section having a first end pivotally connected to said knee section and a second free end, said foot section being adapted to move in response to pivotal movement of said knee section; and a ramp assembly including:

a ramp attached to one of said free end of said foot section or said bed frame; and a leg rigidly connected to the other one of said free end of said foot section or said bed frame, said leg rotatably supporting a wheel which is in contact with said ramp to support said free end of said foot section, said ramp assembly maintaining a spaced relation between said bed frame and said free end of said foot section to prevent said foot section from contacting said bed frame during movement of said knee section.

2. A ramp assembly for use with an articulating bed having a first bed component and a second bed component, one of the bed components being movable and the other one of the bed components being stationary, said ramp assembly for preventing the movable bed component for contacting the stationary bed component during movement of the movable component, said ramp comprising:

a ramp attachable to the other one of the bed components, said ramp comprising opposed channels;

a slideable member connected to the other one of the bed components, said slideable member contacting said ramp, said slideable member and said ramp cooperating to maintain spaced relation between the movable bed component and the stationary bed component during movement of the movable bed component; and a leg for connecting said contact member to one of the movable bed components, said leg having a first end and a second end, said first end of said leg supporting said slideable member, said second end of said leg being rigidly attached to the movable bed component.

3. A ramp assembly for use with an articulating bed having a first bed component and a second bed component, one of the bed components being movable and the other one of the bed components being stationary, said ramp assembly for preventing the movable bed component for contacting the stationary bed component during movement of the movable component, said ramp comprising:

at least two ramps, each one of said ramps being attachable to one of the bed components, each one of said ramps comprising opposed channels;

at least two slideable members, each one of said slideable members connected to the other one of the bed components, each one of said slideable members including opposed sides, said opposed sides of each one of said slideable members being slideably engageable with said opposed channels of a respective one of a respective one of said slideable member, said slideable member contacting said ramp, said slideable member and said ramp cooperating to maintain a spaced relation between the movable bed component and the stationary bed component during movement of the movable bed component; and at least two legs, each one of said legs for connecting a respective one of said slideable members to the other one of the slideable members to the other one of the slideable members, each one of said legs having a first end and a second end, said first end of said leg supporting a respective one of said slideable members, said second end of said leg being attached to the movable bed component.

* * * * *